US010093503B2

(12) United States Patent
Bertolino

(10) Patent No.: US 10,093,503 B2
(45) Date of Patent: Oct. 9, 2018

(54) METHOD AND MACHINE FOR DISCHARGING A ROLL OF TAPE FROM A WINDING SPINDLE

(71) Applicant: S.I.C.M.A. S.p.A. SOCIETA' INDUSTRIALE COSTRUZIONI MECCANICHE E AFFINI, Mondovi' (IT)

(72) Inventor: Michele Bertolino, Vicoforte (IT)

(73) Assignee: S.I.C.M.A. S.p.A. SOCIETA' INDUSTRIALE COSTRUZIONI MECCANICHE E AFFINI, Mondovi' (IT)

( * ) Notice: Subject to any disclaimer, the term of this patent is extended or adjusted under 35 U.S.C. 154(b) by 134 days.

(21) Appl. No.: 15/178,006

(22) Filed: Jun. 9, 2016

(65) Prior Publication Data

US 2016/0362270 A1 Dec. 15, 2016

(30) Foreign Application Priority Data

Jun. 9, 2015 (IT) ..... 102015000021788

(51) Int. Cl.
*B65H 19/30* (2006.01)

(52) U.S. Cl.
CPC ..... *B65H 19/30* (2013.01); *B65H 2301/4175* (2013.01); *B65H 2405/422* (2013.01)

(58) Field of Classification Search
CPC ..... B65H 19/30; B65H 2301/4175; B65H 2405/422
See application file for complete search history.

(56) References Cited

U.S. PATENT DOCUMENTS

| | | | | |
|---|---|---|---|---|
| 2,738,138 A * | 3/1956 | Gordon | B21C 47/24 242/559.3 |
| 3,690,583 A | 9/1972 | Herman | |
| 5,562,385 A * | 10/1996 | Tacchi | B65H 19/12 242/559.4 |
| 5,674,049 A * | 10/1997 | Pienta | B65G 47/252 414/390 |
| 2009/0116948 A1* | 5/2009 | Keller | B65H 19/126 414/754 |

FOREIGN PATENT DOCUMENTS

| | | |
|---|---|---|
| EP | 1514820 A1 | 3/2005 |
| WO | 03/010078 A1 | 2/2003 |
| WO | 2012/108114 A1 | 8/2012 |

OTHER PUBLICATIONS

Italian Search Report for related Italian Appln. No. ITUB20151187, dated Feb. 26, 2016, and partial English translation.

* cited by examiner

*Primary Examiner* — Sang K Kim
(74) *Attorney, Agent, or Firm* — FisherBroyles, LLP; Robert Kinberg

(57) ABSTRACT

Method and machine for discharging at least one roll of tape from a winding spindle, according to which a cradle for partially housing the roll is fed by means of a motorized cart with wheels rolling on the floor below the roll and is then lifted to bring the roll into engagement with the cradle; during lifting of the cradle, the position of the same cradle with respect to the cart is adjusted in a horizontal plane by the action exerted by the same roll mounted on the winding spindle.

6 Claims, 4 Drawing Sheets

1
2
3A
3
20
6
7
5
28
26
22
14
19
18
15
11
16
13
10

8
34
31
30
23
24
7
3
5
10
26
11
19
14
15
22
18

METHOD AND MACHINE FOR DISCHARGING A ROLL OF TAPE FROM A WINDING SPINDLE

CROSS-REFERENCE TO RELATED APPLICATION

This application claims priority to Italian Patent Application No. 102015000021788, filed on Jun. 9, 2015, which is incorporated herein by reference in its entirety.

FIELD OF THE INVENTION

The present invention relates to a method and to a machine for discharging one or more rolls of tape from a winding spindle arranged in a winding station.

In particular, the present invention can be advantageously applied in the field of forming and transferring rolls of paper material from a motorized forming spindle rotating about a fixed horizontal axis, raised from the ground and lying on a vertical plane.

The rolls of paper material, once formed on the spindle, are discharged by means of a pick-up and handling unit dedicated to the same spindle.

The unit comprises a motorized cart movable in opposite directions on a guide rail fixed to the floor to guide the cart in a fixed translation direction parallel to the axis of the spindle and lying on the aforesaid vertical plane.

The cart carries a V-shaped cradle for housing the roll, symmetrical with respect to the vertical plane. Between the cart and the cradle a lifting device is provided, for moving the cradle in opposite vertical directions orthogonal to the axis of the spindle and intersecting the axis of the same spindle.

The roll is discharged by feeding the cart and carrying, first, the cradle below the roll, afterwards the same cradle is lifted, the roll is progressively housed in the cradle until the spindle is discharged. At this point, after being axially blocked in the cradle, the roll is progressively slipped out from the spindle and moved away from the winding station.

BACKGROUND OF THE INVENTION

Although known discharge units are used universally, as they are able to ensure a precise positioning of the cradle with respect to the spindle, as required by the narrow clearance, of the order of one millimeter, between spindle and core of the roll, they are, on the one hand, units dedicated to only one spindle and, on the other, rigid units from a functional point of view as they are only able to set down the picked up rolls in predefined points along the rail.

Attempts to solve the aforesaid problems have been made by replacing the cart on rails with a cart with wheels on the floor with position control. However, these carts have proved to be less than satisfactory, as the maximum positioning precision of these controlled carts is of the order of twenty millimeters and this does not allow the roll to be slipped out of the spindle without generating bending moments on the spindle or irreparable damage to the roll, or keeping the picked up rolls perfectly coaxial in the case in which a pack of rolls placed next to one another is to be discharged.

SUMMARY OF THE INVENTION

The object of the present invention is to provide a method for discharging a roll of tape from a winding spindle, which allows the aforesaid problems to be solved in a very simple and economical way.

According to the present invention, there is provided a method for discharging at least one roll of tape from a winding spindle, the method comprising the steps of using a motorized cart with wheels rolling on the floor and a cradle for partially housing said roll carried by said cart, of feeding the cart towards the spindle while keeping the cradle in a waiting lowered position until arranging the cradle below said roll, of lifting vertically the cradle by moving it towards the roll, of bringing the roll into engagement with the cradle and of slipping the roll out from said spindle by moving backwards said cart, characterized in that said lifting step comprises a simultaneous adjustment step of the position of said cradle in a horizontal plane with respect to said cart.

Preferably, in the method defined above, the adjustment step is performed by exerting at least a pushing action on said cradle by means of said roll.

The present invention also relates to a machine for discharging a roll of tape from a winding spindle.

According to the present invention, there is provided a machine for discharging at least one roll of tape from a winding spindle, the machine comprising a motorized cart with wheels rolling on the floor, a cradle for partially housing said roll carried by said cart and motorized lifting means for lifting said cradle with respect to said cart in a vertical direction, characterized by further comprising relative mobility means interposed between said motorized lifting means and said cradle and designed to allow movement of said cradle with respect to said cart and to said motorized lifting means in a horizontal plane.

Preferably, in the machine defined above, the relative mobility means comprise a plurality of idle rolling bodies.

BRIEF DESCRIPTION OF THE DRAWINGS

The invention will now be described with reference to the accompanying drawings, which illustrate a non-limiting example of embodiment thereof, wherein.

DETAILED DESCRIPTION OF THE INVENTION

In the accompanying figures, the numeral 1 indicates as a whole a winding station of a system 2 for forming rolls 3 of tape, for example paper, known per se.

Figure 4:
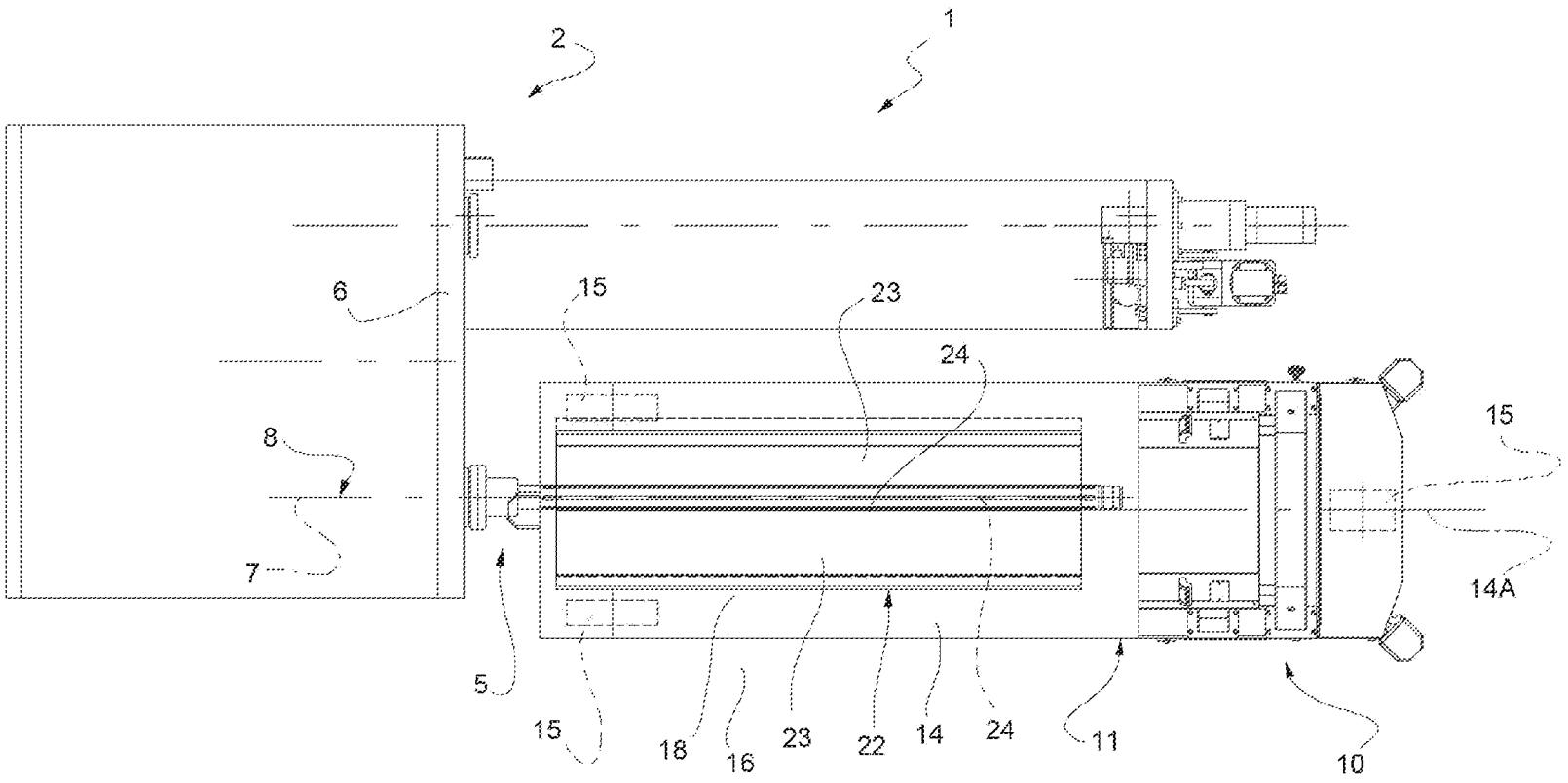
FIGS. 4 and 5 are plan views of the machine of FIG. 1 in two different operating positions.
Figure 5:
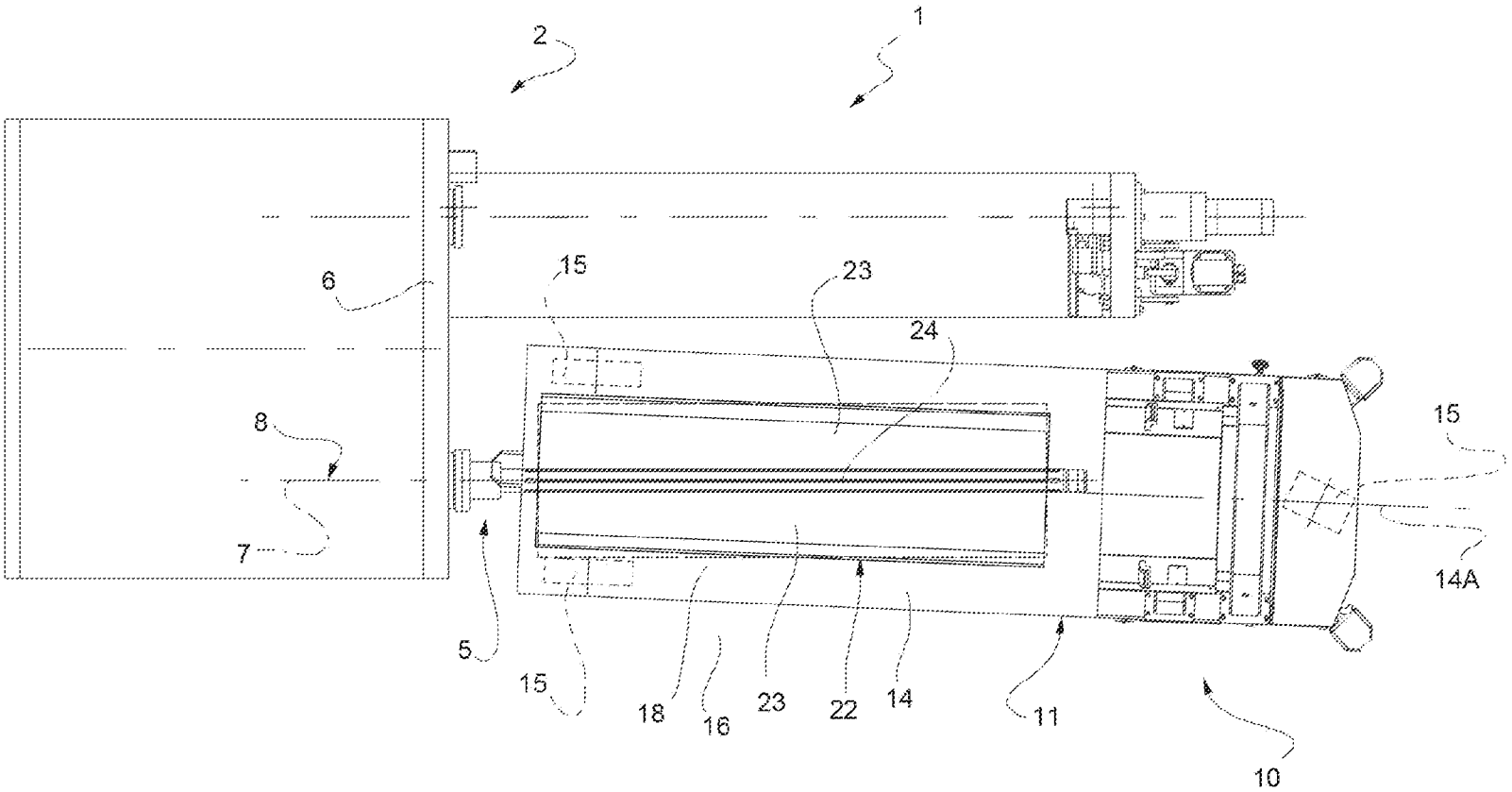

The winding station 1 comprises a motorized spindle 5 for winding or forming the rolls 3, known and not described in detail, which extends in a cantilever fashion from a supporting structure 6 and is coupled to the same structure 6 in a position axially fixed and in a rotating manner about a fixed horizontal axis 7, raised from the ground and lying on a vertical plane 8, the trace of which is indicated with 8 in FIGS. 4 and 5.

Figure 1:
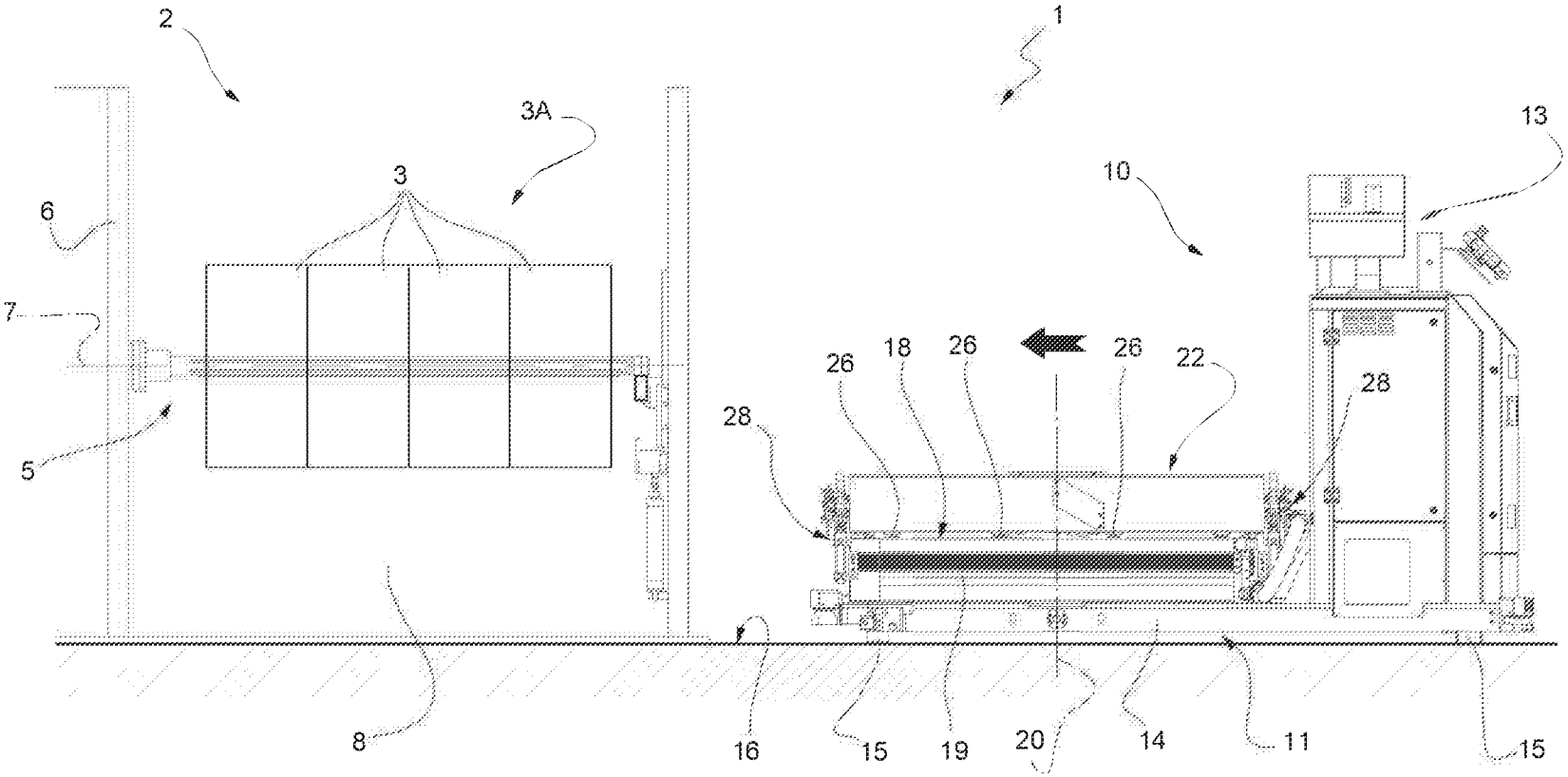
FIG. 1 illustrates, schematically and substantially in blocks and in side elevation, a preferred embodiment of a machine for discharging one or more rolls of tape formed on a forming spindle.
Figures 2, 3:
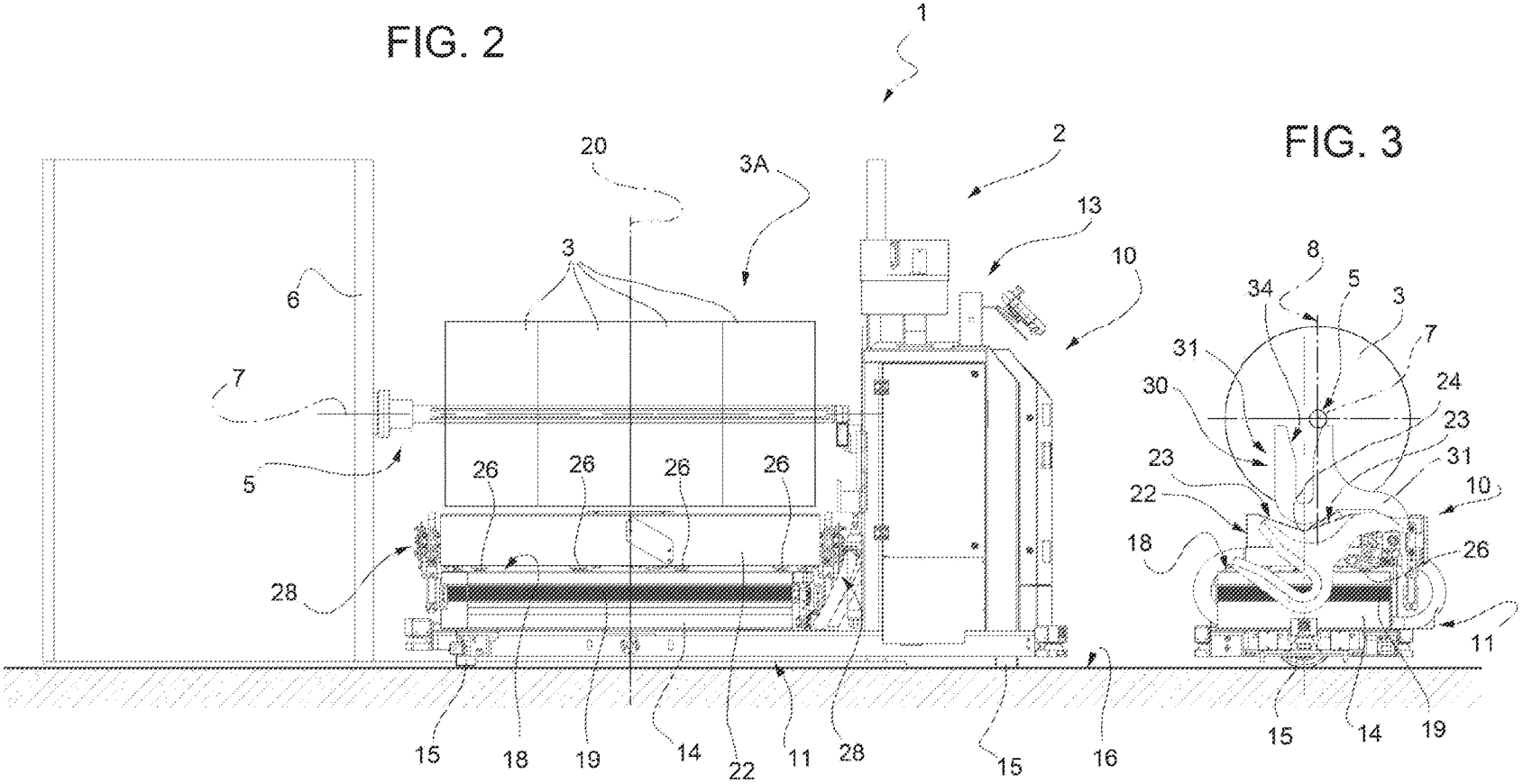
FIG. 2 is a figure analogous to FIG. 1 and illustrates the machine of FIG. 1 in a different operating position.
FIG. 3 is a section according to the line III-III of FIG. 2.

On the spindle 5 there can be formed simultaneously several rolls 3 forming a pack 3A of rolls 3 placed next to one another along the spindle 5, as illustrated in the accompanying FIGS. 1 and 2, or a single roll 3. Here and hereinafter, to facilitate discussion and for clarity a single roll 3 will be considered.

The roll 3 formed on the spindle 5 is discharged and moved away by means of a pick-up and transfer machine, indicated as a whole with 10.

The machine 10 comprises a motorized cart 11, advantageously a controlled cart of the type known as "AGV" cart. The position of the cart 11 is controlled by a proper electronic unit for position management and control, known per se and indicated as a whole with 13 (FIGS. 1 and 2).

The cart 11 comprises a chassis 14 and a plurality of wheels 15 coupled to the chassis 14 and rolling directly on a floor 16. Here and hereinafter the term rolling on the floor is intended to mean wheels not guided on the floor by guides or other tracks blocked on the floor. In the specific case, the cart 11 comprises a pair of front wheels, i.e. on the side facing the structure 6, idle and blocked on the chassis 14 in angularly fixed position and a single central rear wheel, driving and motorized (FIG. 5).

With reference to FIGS. 1 and 2, the cart 11 comprises, on the side facing the structure 6, a moving horizontal loading plane 18 and a motorized guiding and handling assembly 19 interposed between the loading plane 18 and the chassis 14 to move the loading plane 18 vertically in opposite directions with respect to the chassis 15 in a vertical direction 20. The assembly 19, known per se and not described in detail, is advantageously of the pantograph type.

Again with reference to FIGS. 1 and 2, the machine 10 also comprises a V-shaped cradle 22, which is designed to partially house the roll 3 and is supported by the supporting plane 18. In the described particular example, the cradle 22 comprises two inclined walls 23 facing and converging towards each other and towards the supporting plane 18 until they join at a bottom edge 24 (FIGS. 3, 4 and 5). The cradle 22 is resting on a supporting plane 18 through the interposition of a plurality of rolling bodies 26, preferably spherical, which, in the particular example described, are coupled idle and in a way known per se, to a supporting frame thereof, in turn stably connected to a lower end portion of the cradle 22. Alternatively, according to a variant, not illustrated, the rolling bodies 26 are idly coupled to the supporting plane 18. In both cases, the rolling bodies 26 allow a free movement of the cradle 22 on the supporting plane 18. Fixed perimeter stops or end-of-stroke elements are provided on the supporting plane 18 to keep the cradle 22 on the same supporting plane 18 at all times.

Finally, again with reference to FIGS. 1 and 2, the machine 10 comprises a mechanical device 28 for snap locking the cradle 22 in a predefined reference position on the supporting plane 18 (FIGS. 1 and 2). Advantageously, the locking devices 28 comprise a pair of arms or levers hinged to the supporting plane 18 and, for each lever, an abutment carried by the cradle 22 and defining a retaining seat engageable by the respective lever to fix the cradle 22 on the supporting plane 18 in a position such that the edge 24 of the cradle coincides with a section of a longitudinal axis 14A of the cart 14. Alternatively, according to a variant, not illustrated, the levers are replaced by translating strut pins.

Finally, the machine 10 comprises a pair of retaining jaws 30 arranged on opposite axial sides of the cradle 22 for axially retaining the roll 3 inside the same cradle 22. In the particular example described and with reference to FIG. 3, each jaw 30 comprises a motorized arm 31 having an end portion hinged to the cradle 22 to rotate about a relative axis parallel to the bottom edge 24 of the cradle 22.

Each jaw 30 also comprises an engaging portion 32, which is stably connected to the respective arm 31 and delimits an open slot having an outwardly flared inlet end section 34.

Removal of the roll 3 from the spindle will now be described starting from the condition illustrated in FIG. 1, in which the cart 11 is arranged in any position outside the winding station 1 with the cradle 22 arranged in a waiting lowered position and blocked in the reference position by the devices 28 and the jaws 30 arranged in their lowered position, indicated with a dashed line in FIG. 3.

Starting from this condition, the cart 11, by means of steering of the rear wheel 15, is inserted into the station 1 and controlled so as to carry the cradle 22 below the roll 3. At this point, the cradle 22 is released from engagement with the supporting plane 18, by releasing the devices 28 and by rotating and bringing the jaws 30 to their retaining position illustrated with a continuous line in FIG. 3; afterwards, by means of the handling assembly 18, the cradle 22 is lifted progressively. During lifting, if the bottom edge 24 of the cradle 22 does not coincide with the vertical plane 8 but it is, for example, eccentric with respect to this plane 8 as illustrated in FIG. 3 and with a continuous line in FIG. 4, or the bottom edge 24 and the plane 8 are not parallel but skewed, as illustrated with a continuous line in FIG. 5, one or both the tilted walls 23 rest on the roll 3 and further lifting causes movement of the cradle 22 on the supporting plane 18 permitted by the rolling bodies 26 until the bottom edge 24 coincides exactly with the plane 8. During this step, the flared section 34 of the jaws 30 allows progressive insertion of the spindle 5 into the same jaws 30. At the end of the lifting step, the cart 11 is moved backwards and the roll 3 progressively slipped out from the spindle 5. When the bottom edge 24 and the plane 8 are skewed, during slipping out the cradle 22 moves on the supporting plane 18 preventing the occurrence of stresses on the spindle 5 and/or on the roll 3 due to the backward movement of the cart 11 along a different direction to the axis 7 of the spindle 5. At the end of the slipping out step, the cradle 22 is lowered and then positioned and blocked on the supporting plane 18 by means of the devices 28; afterwards, the same roll 3 is moved to any point of the system 2 as the cart 11 has no limits in the direction or trajectory it can take.

From the foregoing it is evident how the method of discharging rolls described allows the use of common carts with position control, the complete elimination of guides or tracks on the floor for the same cart, and arrangement of cradle in a predefined position for receiving the roll in a very simple way and without the need for controls, automations or operations by the operator. In fact, when the cradle is arranged in a position different than the aforesaid reference position, due to interaction with the roll it receives thrust actions by the same roll and moves spontaneously on the supporting surface until reaching, autonomously and without further external actions, the reference position at the end of the lifting step. This is made possible by presence of the idle rolling bodies provided between cradle and cart that make the cradle idle on the supporting surface.

The invention claimed is:

1. A method for discharging at least one roll of tape from a winding spindle, the method comprising the steps of;

using a motorized cart with wheels rolling on a floor and a cradle for partially housing said roll carried by said cart;

feeding the cart towards the spindle while keeping the cradle in a waiting lowered position until arranging the cradle below said roll, lifting vertically the cradle by moving the cradle towards the roll;

bringing the roll into engagement with the cradle and simultaneously adjusting the position of the cradle in a horizontal plane with respect to the cart during a continued lifting of the cradle; and slipping the roll out from the spindle by moving the cart backwards.

2. The method according to claim 1, wherein said adjusting is performed by exerting at least a pushing action on said cradle by means of said roll.

3. The method according to claim 1, wherein said adjusting comprises a spontaneous passive adapting step of said cradle due to a thrust exerted directly by said roll onto said cradle.

4. The method according to claim 1, comprising a further spontaneous adjustment adjusting of the position of said cradle on said horizontal plane during said step of slipping out the said roll.

5. The method according to claim 1, further comprising the step of locking the said cradle with respect to said cart after the slipping out of said roll from said spindle.

6. The method according to claim 1, wherein the simultaneous adjusting step includes simultaneously adjusting to allow free movement in the horizontal plane with respect to said cart and to said motorized lift.

* * * * *